US005431202A

United States Patent [19]

Dikeman et al.

[11] Patent Number: 5,431,202

[45] Date of Patent: Jul. 11, 1995

[54] MEDICAL FLUID FLOW CONTROL SYSTEM AND COMPOUNDER APPARATUS

[75] Inventors: W. Cary Dikeman, 12619 Pawnee La., Leawood, Kans. 66209; Ronald Kemnitzer, Leawood, Kans.

[73] Assignee: W. Cary Dikeman, Leawood, Kans.

[21] Appl. No.: 123,146

[22] Filed: Sep. 17, 1993

[51] Int. Cl.[6] ..... B65B 1/04; B65B 3/04

[52] U.S. Cl. ..... 141/105; 141/349; 141/107; 141/94; 137/606

[58] Field of Search ..... 141/83, 94, 105, 104, 141/236, 312, 329, 106, 107, 349, 383; 604/151, 152, 153, 154, 155, 410, 411; 222/145; 137/566, 606, 512, 539, 540; 251/149.7

[56] References Cited

U.S. PATENT DOCUMENTS

| | | | |
|---|---|---|---|
| 3,563,267 | 2/1971 | Thompson | 137/329.1 |
| 4,091,839 | 5/1978 | Donner | 137/539 |
| 4,150,673 | 4/1979 | Watt | 141/382 |
| 4,365,648 | 12/1982 | Grothe | 137/539 |
| 4,411,652 | 10/1983 | Kramer et al. | 604/153 |
| 4,648,430 | 3/1987 | Di Gianfilippo et al. | 141/83 |
| 4,718,467 | 1/1988 | Di Gianfilippo et al. | 141/105 |
| 4,915,688 | 4/1990 | Bischof et al. | 137/606 |
| 4,959,053 | 9/1990 | Jang | 604/411 |
| 5,040,699 | 8/1991 | Gangemi | 141/105 |
| 5,128,048 | 7/1992 | Stewart et al. | 604/410 |

*Primary Examiner*—Robert M. Fetsuga
*Assistant Examiner*—Steven O. Douglas
*Attorney, Agent, or Firm*—Hovey, Williams, Timmons & Collins

[57] ABSTRACT

A liquid supply set and receiver set are provided for use with an apparatus for compounding liquids from a plurality of supply containers. The supply set includes a plurality of lines connected to a delivery manifold. Each line includes an elongated connector joining two sections of the line together, and each connector includes an inlet extending in a direction perpendicular to the length of the connector and an outlet extending from an end of the connector. The supply set cooperates with a receptacle formed in the frame of the apparatus to properly position the lines for use and to provide an indication of which line corresponds with which supply bottle being used. The receiving set and supply set include cooperative structure for permitting attachment of the receiving set with the supply set while preventing leakage from the supply set when the receiving set is not in place.

29 Claims, 3 Drawing Sheets

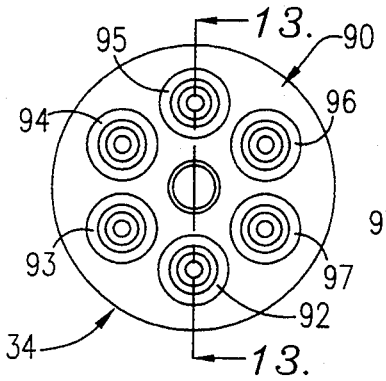
FIG. 11.
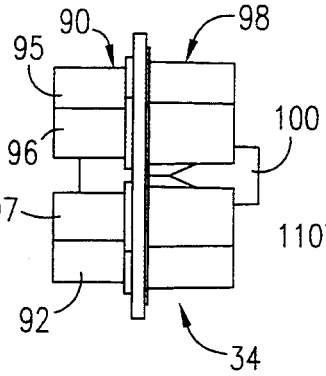
FIG. 9.
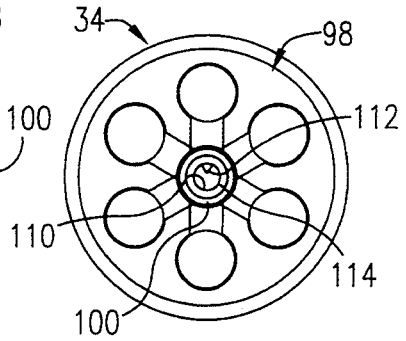
FIG. 10.
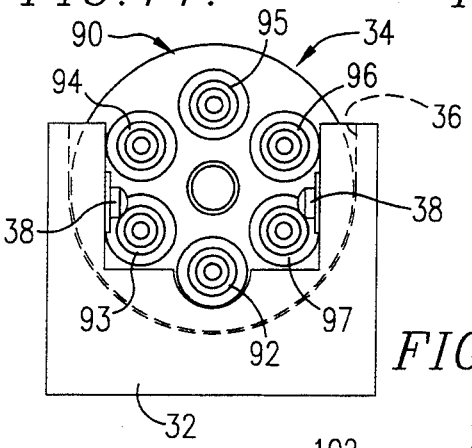
FIG. 16.
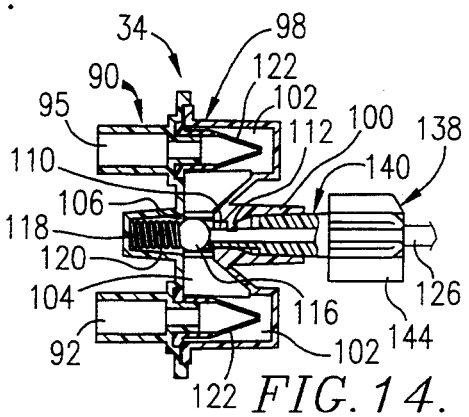
FIG. 14.
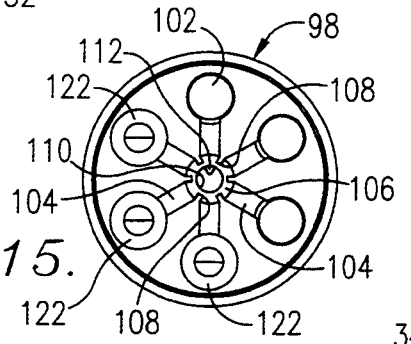
FIG. 15.
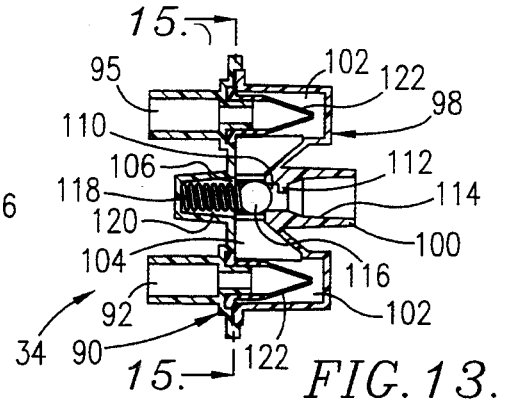
FIG. 13.
FIG. 12.
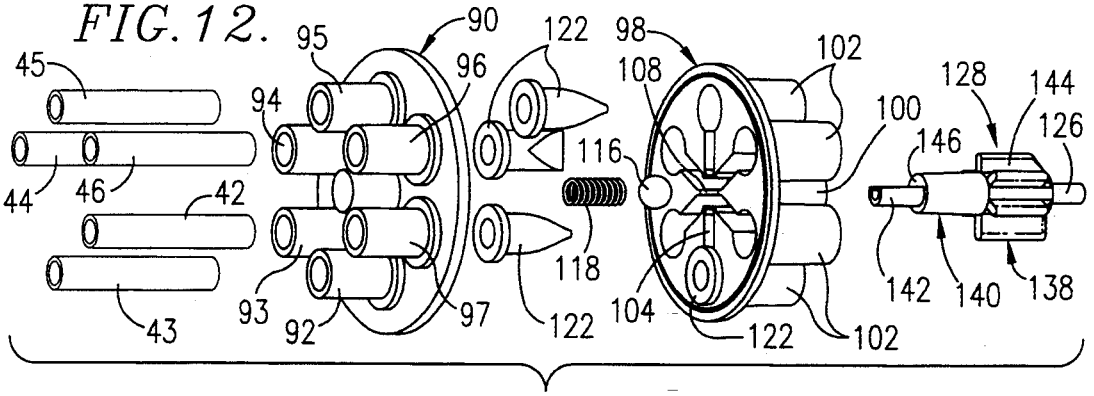

MEDICAL FLUID FLOW CONTROL SYSTEM AND COMPOUNDER APPARATUS

BACKGROUND OF THE INVENTION

1. Field of the Invention

The present invention relates to an apparatus for compounding medicinal and/or nutritional liquids from a plurality of pharmaceutical supply bottles to provide a single mixed liquid, and also to a disposable supply set and receiving set for use with such a compounder apparatus.

2. Discussion Of the Prior Art

Numerous illnesses and treatment side effects inhibit normal functioning of the human digestive track, presenting a need for a parenteral supply of nutrition to the patient which bypasses the ailing digestive track.

It is conventional for a hospital or home pharmacy to have on hand a supply of various nutritional fluids which may be compounded in accordance with any desired formula to furnish a particular patient with the nutritional requirements specific to that patient. Such compounders typically include one or more pumps and a support means overhanging the pumps for supporting a plurality of supply bottles on the device. Each of the supply bottles holds a different nutritional fluid, or medicinal fluid if desired, and the pumps draw fluids from the bottles successively, and mix or compound the fluids into a single receiving container that is then ready for use with the patient.

By combining the various available fluids together, it is possible to provide total parenteral nutrition (TPN) to the patient. For example, fluids including dextrose (sugar), fatty acids (fats), amino acids (protein), electrolytes (sodium, potassium etc.), or other nutritional fluids may be compounded with sterile water to provide any particular patient with all of their nutritional requirements without the need for enteral introduction of such nutrients.

In order to reduce the opportunity for germs and bacteria to contaminate the fluid being mixed in a conventional apparatus, it is known to provide both a disposable supply set and a disposable receiving set for use with the compounder. The supply set includes a plurality of lines, each including a pair of relatively clear, small diameter tubing sections formed of polyvinylchloride (PVC) and an intermediate, large diameter tubing section formed of silicon tubing coupled between the two PVC sections. The supply set also includes a manifold having a plurality of inlets to which the lines are attached, and a single outlet through which liquid is dispensed. A valve is positioned within the outlet of the manifold in an attempt to prevent liquid from leaking from the manifold.

The receiving set includes a receiving bag, a line connected to the bag, and an end connector for connecting the line to the outlet of the manifold. The end connector presents a tubular male member which penetrates the outlet of the manifold during setup and opens the valve to allow liquid to flow to the bag.

Numerous problems are presented by conventional compounders and the sets used to transfer fluid from the various supply bottles to the receiving bag. For example, because as many as five or more supply bottles are supported on the apparatus for any given mixing operation, tubing from the lines of a conventional supply set easily become tangled, or are inadvertently connected to the wrong bottles by an operator during setup so that the formula mixed is incorrect. Further, it is possible for a line to be improperly threaded through the associated pump of the device so that the pump is unable to pump liquid through the line, or so that the line is out of registration with any convetional type of flow sensor mounted alongside the pump.

Another problem present in conventional compounder constructions relates to the absence of any reliable means in the manifold of the supply set to prevent fluid within the manifold from being reintroduced into the various supply lines from the manifold when fluid is not being pumped through those lines. As a result, it is possible that fluid from one supply bottle does not reach the receiving bag, but rather is pumped through the manifold back into one of the remaining lines of the supply set. Such displacement of the fluid reduces the accuracy of the apparatus and adversely affects the quality of the mixture produced.

Further although it is known to provide a valve in the outlet of the manifold, conventional valves represent a weak effort to actually prevent leakage, resulting in constructions which provide less than desirable results. Such leakage is significant where the apparatus is to be used to measure a very accurate dosage of nutritional or medicinal liquid from a bottle to the receiving bag, and renders the conventional construction impractical.

OBJECTS AND SUMMARY OF THE INVENTION

It is an object of the present invention to provide a compounder, supply set and receiving set which are easy to assemble, use and replace, and which cooperate to provide reliable setup and operation. This object is achieved in part by providing a combination including a compounder apparatus and a supply set that cooperate to provide automatic registration of the lines of the supply set with a sensing means for sensing flow through each of the lines.

Further, it is an object to provide such a combination which ensures proper placement of the lines relative to the pumping means so that each line is in operative communication with the proper pump.

It is another object of the invention to provide a supply set provided with an outlet manifold having a valve means for controlling delivery of compounded liquid from the apparatus to the receiving set so that fluid is only transferred when the receiving set is properly locked in place on the manifold.

Another goal of the present invention is to provide a supply set provided with a manifold which prevents liquid from any of a plurality of lines from contaminating any of the remaining lines so that the quality and content of the mixtures produced by the compounder apparatus are improved.

To provide a receiving set which is easily attached to and removed from the supply set is another object of the invention. The receiving set also provides a means for actuating the valve means of the manifold to release liquid from the supply set when the receiving set is in place.

In accordance with these and other objects evident from the following description of a preferred embodiment of the invention, a supply set and receiving set are provided for use with an apparatus for compounding a plurality of liquids.

The liquid supply set includes a plurality of liquid supply lines and a delivery manifold. In accordance with one aspect of the invention, the manifold includes a plurality of inlets, a single outlet, an internal volume providing fluid communication between the inlet and the outlet, a valve means for controlling the flow of liquid from the outlet, the valve means being movable between a flow-preventing position and a flow-permitting position, and a biasing means for biasing the valve means toward the flow-preventing position.

The valve means includes a seat formed in the outlet and a ball valve movable toward and away from the seat, the biasing means including a compression spring positioned within the internal volume between the manifold and the valve for biasing the valve toward the seat. In addition, the manifold includes a guide means for guiding movement of the ball valve between seated and unseated positions.

The manifold may also include a check valve means positioned between the internal volume of the manifold and each of the lines for permitting liquid flow from the lines into the internal volume while checking the flow of liquid from the internal volume back into the lines.

The receiving set includes a receiving container for receiving compounded liquid from the supply set, a receiving line in fluid communication with the container, and an end connector for connecting the line to the outlet of the manifold.

The end connector includes a gripping portion by which the connector may be handled, an intermediate locking portion for locking the line in fluid communication with the outlet, and an axially extending key means sized for receipt in the outlet of the manifold for moving the valve means from the flow-blocking position to the flow-permitting position to release compounded liquid within the manifold to the receiving set when the end connector is locked in the outlet.

Preferably, the key portion of the end connector is an axial extension of the locking portion, having a generally arcuate crescent shape of a diameter smaller than the diameter of the locking portion, the outlet including a projection protruding into the outlet and defining a crescent shaped opening through which the key portion of the end connector is received so that the key portion can move the valve means from the flow-blocking to the flow-permitting position.

BRIEF DESCRIPTION OF THE DRAWING FIGURES

A preferred embodiment of the present invention is described in detail below with reference to the attached drawing figures, wherein:

FIG. 8 is a front elevational view of the receiving set;

FIG. 9 is a side elevational view of a manifold of the supply set;

FIG. 10 is an outlet end elevational view of the manifold;

FIG. 11 is an inlet end elevational view of the manifold;

FIG. 12 is an exploded view of the manifold, illustrating assembly of the manifold;

FIG. 13 is a sectional view of the manifold taken along line 13—13 of FIG. 11, illustrating a valve of the manifold in a flow-preventing position;

FIG. 14 is a sectional view of the manifold taken along line 13—13 of FIG. 11, illustrating the valve of the manifold in a flow-permitting position;

FIG. 15 is a sectional view of the manifold taken along line 15—15 of FIG. 13; and FIG. 16 is an inlet end elevational view of the manifold and a cradle of the compounder within which the manifold is supported.

DETAILED DESCRIPTION OF THE PREFERRED EMBODIMENT

Figure 1:
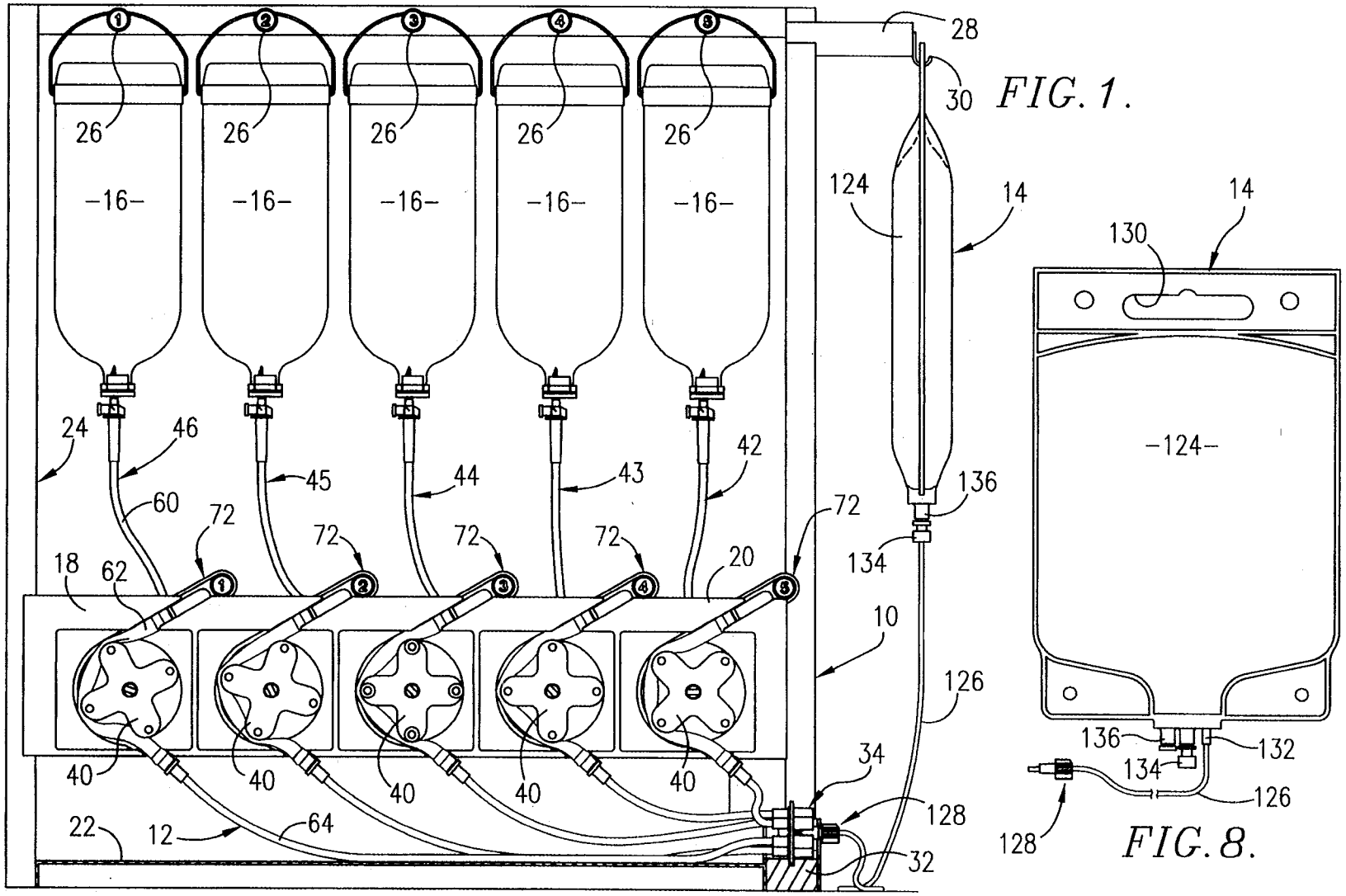
FIG. 1 is a front elevational view of a compounder apparatus, supply set and receiving set constructed in accordance with a preferred embodiment of the invention.

A compounder apparatus 10, supply set 12 and receiving set 14 constructed in accordance with the preferred embodiment of the present invention is shown in FIG. 1. In addition, a plurality of supply bottles 16 are shown, which are of conventional construction and available from many different pharmaceutical supply companies.

The compounder 10 includes a frame presenting a front wall 18, a top wall 20, and a front channel 22 running the length of the frame along the lower edge of the front wall. An upstanding support assembly 24 is connected to the frame and includes a plurality of numbered hooks 26 from which the supply bottles may be suspended. If desired, the hooks 26 may each be colored different from the others to distinguish the bottle positions from one another.

A load cell 28 is also provided on the support assembly 24, and extends from an end of the assembly beyond the frame of the apparatus. The load cell is provided with a hook 30 from which the receiving set 14 is suspended during a compounding operation, and the cell measures the weight of the liquid transferred to the receiving set.

The channel 22 along the front of the apparatus is adapted to receive the supply set during operation of the apparatus, and a cradle 32 is provided at an end of the channel for supporting a manifold 34 of the supply set 12.

As shown in FIG. 16, the cradle 32 is a U-shaped block provided with a means for supporting the manifold of the supply set so that the manifold will not freely lift from the apparatus during use. This support means includes an arcuate channel 36 extending vertically into the cradle and defining a seat within which the manifold is received. In addition, a pair of laterally opposed, spring biased detents 38 are provided for engaging the manifold to hold it in place in the cradle during use.

Returning to FIG. 1, a pumping means is provided on the frame in association with each of a plurality of lines of the supply set for pumping liquid through the lines between the liquid supply bottles 16 and the receiving set 14. Each pumping means preferably includes a peristaltic pump 40 supported on the frame substantially immediately beneath one of the hooks 26 on the support assembly 24 so that each line 42–46 of the supply set leading from the bottles may be threaded directly through one of the pumps. The pumps 40 operate in a conventional manner, squeezing liquid within the lines toward the receiving set 14 as the pumps rotate.

Figures 2, 3, 4, 5, 6, 7:
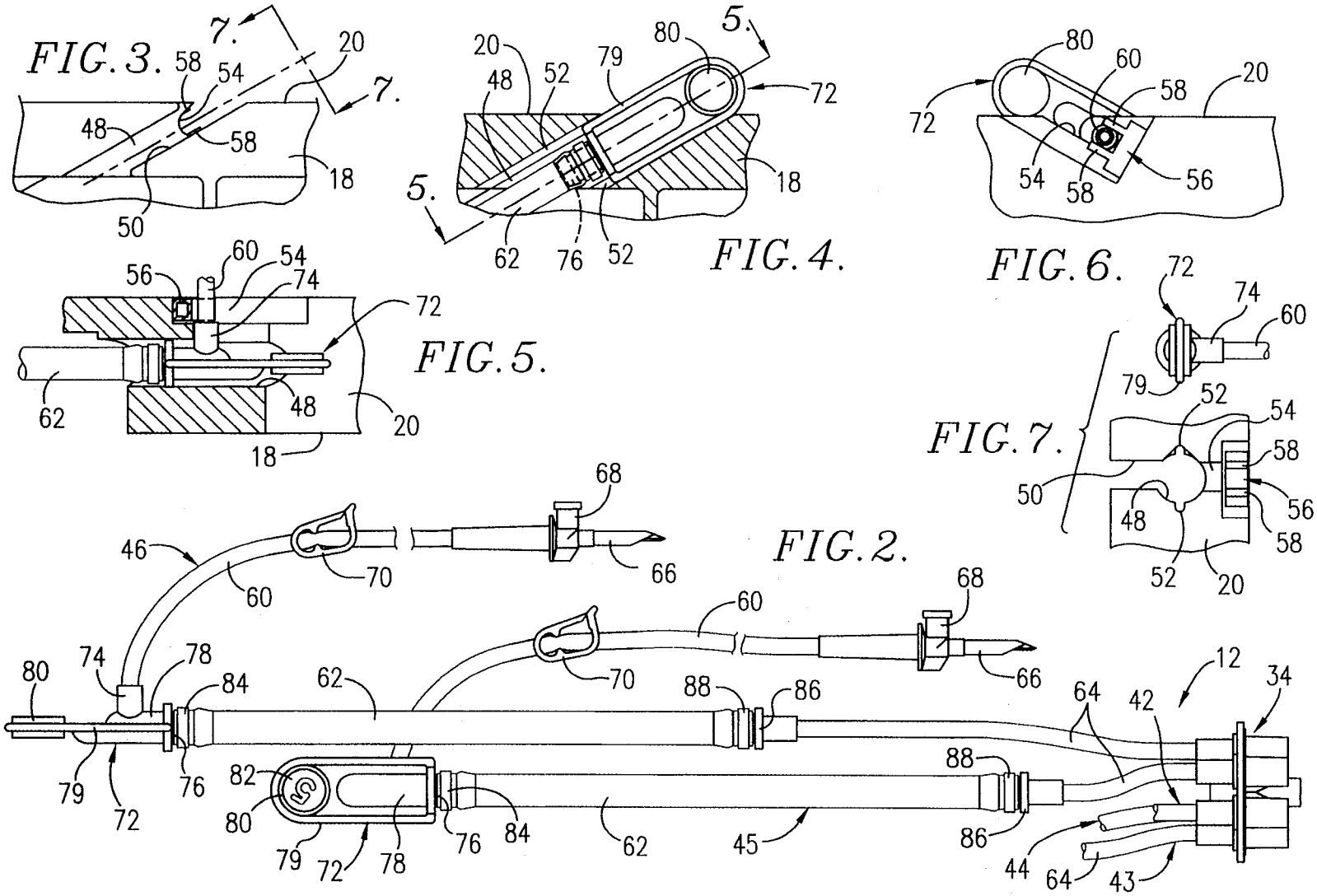
FIG. 2 is a fragmentary perspective view of the supply set.
FIG. 3 is a front elevational view of a frame of the compounder, illustrating a receptacle within which the supply set is received.
FIG. 4 is a sectional view of the receptacle, illustrating a connector of the supply set positioned in the receptacle.
FIG. 5 is a sectional view of the receptacle taken along line 5—5 of FIG. 4.
FIG. 6 is a rear elevational view of the frame, illustrating a sensing assembly supported on the frame adjacent the receptacle.
FIG. 7 is an end view of the receptacle taken along the line 7—7 of FIG. 3, illustrating the orientation of the connector relative to the receptacle.

The front and top walls 18, 20 of the frame define a mounting means for mounting the lines of the supply set relative to the pumps. The mounting means includes an open-ended, elongated receptacle 48 associated with each pump. As shown in FIG. 3, each receptacle extends through the top wall 20 in a first, downward angled direction and includes an elongated slot 50 formed in the front wall 18 and connecting the open ends of the receptacle for permitting access to the receptacle from the front of the apparatus.

As shown in FIG. 7, each receptacle 48 includes a generally cylindrical wall along which a pair of opposed longitudinal channels 52 extend. In addition, a transverse slot 54 is formed in the top wall 20 of the frame adjacent each receptacle, and intersects the associated receptacle at a 90° angle.

A sensing means is associated with each receptacle for sensing flow through one of the lines of the supply set 12. As shown in FIG. 6, each sensing means includes a flow sensor 56 positioned in line with one of the transverse slots 54 in the top wall of the frame. Each flow sensor 56 includes a pair of opposed upstanding fingers 58 which define a flow path along which flow is sensed. As best illustrated in FIGS. 5 and 7, the flow path between the fingers of each sensor 56 extends in a direction parallel to the slot 54.

The construction of the flow sensors is conventional. However, the positioning of each sensor behind one of the receptacles 48 of the frame is unique, and allows the sensors to be positioned out of the way of the user during normal operation of the apparatus. In addition, the positioning of the sensors relative to the receptacles insures that the sensor is properly positioned relative to the supply set when the supply set is in place on the apparatus.

The supply set 12 is shown in FIG. 1, and broadly includes the plurality of lines 42–46 and the manifold 34. The set is shown apart from the apparatus in FIG. 2, and in more detail, the lines 42–46 each include three tubing sections 60, 62, 64. The first and third sections 60, 64 are formed of a relatively hard, clear resin such as polyvinylchloride (PVC), and include a relatively small diameter as compared with the intermediate section 62, which is formed of a material that is more easily compressed than the material of the other sections, e.g. silicon rubber or the like, and is formed of a diameter larger than the diameter of the other sections.

The first tubing section 60 is fitted at one end with a spike 66 for connecting the line to one of the supply containers so that the line provides fluid communication between the container and the manifold. Preferably each spike includes an air check value 68 for allowing air into the supply bottle as liquid is drained. A clamping means is provided on the first section for clamping the line to close off liquid flow. This means preferably takes the form of a simple, hand-actuated plastic clamp 70 that may be squeezed to shut off flow through the line or released to permit flow.

The end of each first tubing section 60 opposite the spikes 66 is connected to the second tubing section 62 by a connector 72. This connector is preferably formed of any acceptable food grade resinous material such as a food grade plastic, and includes opposed first and second axial ends, an inlet 74 extending in a direction perpendicular to the length of the connector and being connected to the first tubing section, an outlet 76 extending from the first end of the connector and being connected to the second tubing section 62, and a fluid passageway 78 extending through the connector and being coupled between the inlet and the outlet.

The connector also includes a pair of opposed, protruding edges 79 extending along the sides of the connector between the inlet and outlet. As shown in FIG. 7, the edges are each offset from the inlet 74 by 90° relative to the central axis defined by the connector and the cross sectional shape of the connectors corresponds to the cross sectional shape of the receptacles, with the edges of the connectors aligned with the channels 52.

Returning to FIG. 2, the second end of each connector is formed as a gripping portion 80 by which the connector may be handled. The gripping portion includes a pair of opposed circular display surfaces 82 on which indicia are provided for distinguishing each line from the remaining lines. Preferably, as shown in FIG. 1, the indicium on each of the connectors 72 matches the markings on a different one of the hooks 26 of the support assembly 24 so that each line will be properly aligned with a particular supply bottle position and pump during setup. In addition, by coloring each of the display surfaces the same color as the corresponding hook, with each of the hooks a different color, additional protection is provided against inadvertent misalignment of the lines.

Returning again to FIG. 2, the first tubing section 60 is secured within the inlet of the connector by an adhesive or the like, and is in fluid communication with the fluid passageway 78 through the connector 72. The outlet 76 of the connector is received in one end of the second tubing section 62 and is retained on the section by a compression ring 84 or the like. In this fashion, liquid from the first section passes through the connector to the second section.

The third tubing section 64 is attached to the second section 62 by an in-line tubular coupling 86 having a central, radially extending flange and two axially extending ends. The second tubing section 62 is received over one of the coupling ends and is retained on the coupling by a compression ring 88, while the third section 64 is received within the opposite end of the coupling and is retained by an adhesive or the like. A similar method is used to attach the sections 64 to the manifold 34.

The manifold is shown in detail in FIG. 12, and includes a first portion 90 defining a plurality of inlets 92–97, and a second portion 98 defining a single outlet 100, shown in FIG. 10. The two portions 90, 98 are affixed together by ultrasonic welding or the like to define a single body, shown in FIG. 9.

Turning to FIG. 11, the first portion 90 includes at least as many inlets as there are lines in the supply set, there being six inlets in the illustrated embodiment as opposed to five lines. Any of the inlets of the manifold which are not to be used may be sealed off, either during manufacture or some time thereafter. This construction allows some flexibility as to the number of different liquids which may be compounded during any single compounding operation.

As illustrated in FIG. 13, the second manifold portion 98 includes a plurality of elongated cylindrical cavities 102, each of which opposes one of the inlets. These cavities are connected together by passageways 104 extending radially from a central cavity 106, shown in FIG. 15, that is in fluid communication with the outlet 100. Thus, each of the individual cavities are in fluid communication with each other and with the outlet of the manifold.

The central cavity 106 in the second manifold portion is at least partially defined by the parallel edges 108 formed between the various passageways 104. With reference to FIG. 13, the central cavity 106 communicates with the outlet 100 through an outlet passageway 110 having a diameter slightly smaller than the diameter defined by the central cavity 106, and a small, radially extending projection 112 protrudes into the outlet passageway and defines a generally crescent-shaped opening, as shown in FIG. 10.

The purpose of this projection 112 is to prevent a receiving set from being attached to the outlet unless the receiving set includes a "key" of a cross sectional shape corresponding to the shape of the opening, as described below. This construction insures that only particular receiving sets will be accommodated by the supply set, and guarantees that the fit between the receiving set and supply set is liquid tight and that the measurements made by the load cell will be accurate.

Looking again to FIG. 13, the manifold outlet 100 is slightly tapered along the length of the inner surface to define a smooth frustoconical shape adapted to mate with the receiving set in a manner described below. The outlet 100 is connected with the outlet passageway 110 by a tapered region 114 of reduced diameter relative to the outlet.

The manifold 34 includes a valve means for controlling the flow of liquid from the outlet. The valve means includes a ball valve 116, preferably formed of neoprene rubber or the like, that is of a diameter larger than the diameter of the outlet passageway 110 but slightly smaller than the diameter of the central cavity 106. Thus, the passageway 110 defines a seat against which the ball valve rests when in the position shown in FIG. 13 so that liquid is blocked from the outlet. In addition, the edges 108 of the central cavity define a guide means for guiding movement of the ball valve between the seated, flow-preventing position and an unseated, flow-permitting position, as shown in FIG. 14, and prevents the ball valve from moving out of the central cavity.

A biasing means in the form of a stainless steel compression spring 118 is provided in the manifold for biasing the ball valve toward the flow-preventing position. A seat for the spring is provided in the first portion of the manifold by a cavity 120 extending into the portion 90 in a direction parallel to the inlets 92–97.

The manifold is also provided with a check valve means positioned between each of the inlets 92–97 and the internal volume, defined by the cavities 102, the radial passageways 104, and the central cavity 106. The check valve means permits liquid flow from the lines into the internal volume while checking the flow of liquid from the internal volume back into the lines. Preferably, as shown in FIG. 12, the check valve means includes a separate silicon rubber duckbill type check valve 122 positioned in each of the cavities 102 and retained in place between the two manifold portions 90, 98. It is noted that only three such valves are shown in the figures in order to simplify illustration of the invention. However, such valves are provided for every inlet available for use in the manifold.

These check valves 122 permit liquid to flow downstream from the inlets 92–97 into the internal volume of the manifold while preventing flow in the reverse direction. Thus, while liquid is pumped from one of the supply bottles to the receiving set, the liquid enters the manifold and passes directly on to the receiving set without being allowed back up into any of the remaining lines.

The receiving set is illustrated in FIG. 8, and includes a receiving bag 124, a line 126 in fluid communication with the bag, and an end connector 128 attached to the line 126 for connecting the line to the manifold 34.

The bag 124 is preferably formed of an FDA class vinyl, and includes a generally cylindrical side wall closed at the top and bottom to form the bag. The closed top of the bag includes a hole 130 by which the bag may be suspended during use, and the bottom includes three ports 132, 134, 136 allowing fluid communication with the bag. The first port 132 is joined with the line 126 so that liquid delivered through the line is received and stored in the bag during a compounding operation.

The second port 134 is normally closed by a spikable membrane which permits use of the bag with a patient delivery set, such as an intravenous set or the like. The third port 136 is similar to the second port, but is available for allowing medicine to be injected directly into the bag so that the dosage of the medicine may be carefully controlled.

The line 126 is formed of clear PVC, and is attached between the first port 132 of the bag and the end connector 128. The end connector is illustrated in FIG. 13, and includes a gripping portion 138 by which the connector may be handled, an intermediate locking portion 140 for locking the line in fluid communication with the apparatus, and an axially extending key portion 142 sized for receipt in the outlet 100. The end connector 128 is preferably molded as a unitary element of a resinous material.

The gripping portion 138 is generally tubular, and may include an outer surface that is slightly tapered toward the key portion to assist in the molding process. The gripping portion 138 is provided with a plurality of radially extending fins 144 which facilitate gripping and twisting of the end connector. Also, one of the fins may be oversized to enable the user to properly orient the end connector relative to the outlet when positioning the end connector in the manifold.

The locking portion 140 is also tubular, extending between the gripping and key portions, and presents a smooth, tapered frustoconical outer surface corresponding in shape and size to the outlet of the manifold. The locking portion presents an annular end surface 146 opposite the gripping portion 138, and the key portion 142 extends axially from the surface 146.

The key portion 142 is generally U-shaped when viewed from the end of the connector 128, and corresponds generally to the shape presented by the outlet passageway, although the key portion is smaller than the passageway in order to allow liquid to pass through the passageway around the key portion. The key portion resembles a tube having an open slot extending along the length thereof, wherein the slot is larger than but aligned with the projection 112 of the manifold.

The key portion is of a reduced diameter relative to the diameter of the locking portion, and corresponds to the diameter of the outlet passageway 110. As shown in FIG. 14, when the end connector 128 is inserted into the outlet of the manifold, the key portion 142 extends through the passageway past the projection 112, and pushes the ball valve 116 away from the seat against the bias of the spring to the unseated, flow-permitting position.

The tapered locking surface 140 engages the tapered inner surface of the outlet 100 and these surfaces seal against one another as the connector is twisted into the outlet. Thereafter, the end connector is retained in the outlet by the frictional surface engagement between the locking portion and the outlet. Removal of the connector is achieved by twisting the connector while pulling it from the manifold.

With reference to FIG. 1, during setup of the apparatus, the lines 42–46 of the supply set 12 are threaded through the pumps 40 so that the second tubing section 62 of each line engages the associated pump, while the third sections 64 extend beyond the pump and the first sections 60 protrude above the top wall 20. In threading the lines 42–46, each tubing section 62 is brought up through the pump 40 from beneath and stretched in a direction parallel to the receptacles 48 so that the tubing may be guided through the slots 50 into the receptacles before being released. The couplings 86 engage the front wall 18 and prevent the lines from being pulled up through the pumps during this loading operation and during subsequent use.

During this threading operation, the user grips each line by the gripping portion 80 of the connector 72 and uses the connector to stretch and guide the line during loading. Thereafter, as each line is positioned in a receptacle 48 and released, the edges 79 of the connector are aligned with the channels 52 of the receptacle 48 so that as the second tubing section 62 contracts toward its original length, the connector slides into the receptacle in a particular orientation, as shown in FIG. 4, with the indicia on the display surface 82 facing forward of the apparatus.

As each connector 72 slides into one of the receptacles 48, the inlet 74 of the connector is received in the slot 54, as shown in FIG. 5, and prevents the connector from being pulled completely through the receptacle into the pump. At the same time, the connector and receptacle cooperate to position the inlet 74 and first tubing section 60 of each connector between the fingers 58 of one of the flow sensors 56, illustrated in FIG. 6, so that the sensor is properly oriented to detect fluid flow through the line.

Thus, the one simple loading step of fitting each connector into one of the receptacles serves the dual function of properly positioning the first tubing section relative to the sensor and the second section in the pump. In addition, the construction also directs the first sections 60 to the rear of the apparatus away from the user so that the lines do not interfere with a compounding operation, and allows the flow sensors to be positioned out of the way of the pumps.

The manifold 34 is positioned on the frame by sliding the manifold down into the arcuate channel 36 in the cradle 32, as shown in FIG. 16, so that one of the inlets 92 rests in a semicircular cutout of the cradle. The spring loaded detents 38 retract during loading of the manifold, and then protrude inward beyond two of the inlets 93, 97 to hold the manifold against lifting from the cradle. This construction provides a snap-fit between the manifold and cradle.

Returning to FIG. 1, once the lines 42–46 are threaded through the pumps 40, supply bottles 16 are hung from the support assembly 24 in the prescribed order in which they are to be compounded, and the lines are connected to the bottles by piercing the bottles with the spikes 66 of each line. Thereafter, the supply set 12 is ready for use, and is typically replaced once a day after being used in numerous compounding operations.

Once setup of the supply set is complete, or after completion of a previous compounding operation, a fresh receiving set is connected by inserting the end connector 128 into the manifold 34 as shown in FIG. 14. The ball valve 116 prevents any liquid present in the internal volume of the manifold from leaking through the outlet 100 before the end connector is in place and is valuable especially between compounding operations for preventing spills or the like.

By suspending the receiving bag 124 from the hook 30 of load cell 28, it is possible to monitor the weight of liquid being transferred to the bag during a compounding operation so that a proper dosage of each liquid is employed. Preferably, the pumps 40 are each operated in turn so that only a single liquid is transferred at a time. This permits the various dosages to be monitored and permits easy control of the apparatus.

After mixing is complete and the bag 124 is filled with a compounded liquid having the desired contents, the line 126 is crimped, and the end connector 128 is twisted and pulled from the manifold. The ball valve 116 moves to the seated position shown in FIG. 13 under the force of the spring 118, and further discharge of liquid is prevented. The receiving set is disposable, and is discarded after a single use.

Although the invention has been described with reference to the preferred embodiment illustrated in the attached drawing figures, it is noted that equivalents may be employed and substitutions made herein without departing from the scope of the invention as recited in the claims.

What is claimed is:

1. A liquid supply set for use with an apparatus for compounding liquids from a plurality of supply containers, the supply set comprising:

a separate line associated with each supply container; and a delivery manifold in fluid communication with the lines, each line including first and second tubing sections, an elongated connector joining the sections together, and a spike means for connecting the line to one of the supply containers so that the line provides fluid communication between the container and the manifold, each connector being of a predetermined length and including opposed first and second axial ends, an inlet extending in a direction perpendicular to the length of the connector and being connected to the first tubing section, an outlet extending from the first end of the connector and being connected to the second tubing section, a fluid passageway coupled between the inlet and the outlet, and a gripping portion by which the connector may be handled, the gripping portion including a display surface on which indicia are provided for distinguishing each line from the remaining lines.

2. A liquid supply set as recited in claim 1, wherein a spike means includes a vented spike having an air check valve for allowing air into the supply bottle as liquid drains through the supply set.

3. A liquid supply set as recited in claim 1, further comprising clamping means fox clamping the line to close off liquid flow.

4. A liquid supply set as recited in claim 1, wherein the manifold includes a plurality of inlets, a single outlet, an internal volume providing fluid communication between the inlets and the outlet, and a one-way flow valve associated with each line for allowing liquid to flow from each line into the manifold while preventing liquid in the manifold from flowing back into any of the lines.

5. A liquid supply set as recited in claim 1, wherein the manifold includes a plurality of inlets, a single outlet, an internal volume providing fluid communication between the inlets and the outlet, and a valve means for controlling the flow of liquid from the outlet, the valve means being movable between a flow preventing position and a flow permitting position.

6. A liquid supply set for use with an apparatus for compounding liquids from a plurality of supply containers, the supply set comprising:

a separate line associated with each supply container; and a delivery manifold in fluid communication with the lines, each line including first and second tubing sections, an elongated connector joining the sections together, and a spike means for connecting the line to one of the supply containers so that the line provides fluid communication between the container and the manifold, each connector being of a predetermined length and including opposed first and second axial ends, an inlet extending in a direction perpendicular to the length of the connector and being connected to the first tubing section, an outlet extending from the first end of the connector and being connected to the second tubing section, and a fluid passageway coupled between the inlet and the outlet, wherein the first tubing section is connected between the spike means and the inlet of the connector, and is formed of polyvinylchloride, the second tubing section being attached to the outlet of the connector and being formed of a material that is compressible relative to the first tubing section.

7. A liquid supply set as recited in claim 6, wherein the line includes a third tubing section connected between the second tubing section and the manifold, the third tubing section being formed of polyvinylchloride.

8. An apparatus for use in compounding liquids from a plurality of supply containers, the apparatus comprising:

a liquid supply set including a line associated with each supply container, and a delivery manifold, the lines providing fluid communication between the containers and the manifold;

a pumping means associated with each line of the supply set for pumping liquid through that line between one of the liquid supply containers and the delivery manifold;

a frame presenting a front wall and a top wall and including a mounting means for mounting the lines relative to the pumping means, the mounting means including an open-ended, elongated receptacle associated with each line, each receptacle extending through the top wall in a first direction and including an elongated slot formed in the front wall of the frame and connecting the open ends of the receptacle for permitting access to the receptacle from the front of the apparatus; and a sensing means associated with each line of the supply set for sensing flow through the line, the sensing means defining a flow path along which flow is sensed, the flow path extending in a direction perpendicular to the first direction, each line of the supply set including an elongated connector of a predetermined length, each connector having opposed first and second axial ends and being sized for receipt within one of the receptacles, each connector including an inlet extending in a direction perpendicular to the length of the connector, an outlet extending from the first end of the connector, and a fluid passageway coupled between the inlet and the outlet so that when the connector is received in the receptacle, the inlet is aligned with the flow path of the sensing means and the outlet extends through the receptacle.

9. An apparatus as recited in claim 8, wherein each connector includes a gripping portion by which the connector may be handled, the gripping portion including a display surface on which indicia are provided for distinguishing each line from the remaining lines.

10. An apparatus as recited in claim 8, wherein each line includes a spike means for connecting the line to one of the supply containers, the spike means including a vented spike having an air check valve for allowing air into the supply bottle as liquid drains through the supply set.

11. An apparatus as recited in claim 8, further comprising clamping means for clamping each line to close off liquid flow through that line.

12. An apparatus as recited in claim 10, wherein each line includes first and second tubing sections, the first tubing section being connected between the spike means and the inlet of the connector, and is formed of polyvinylchloride, the second tubing section being attached to the outlet of the connector and extending through the pumping means, the second tubing section being formed of a material that is compressible relative to the first tubing section so that the pumping means can compress the second tubing section to pump liquid through the line.

13. An apparatus as recited in claim 12, wherein the line includes a third tubing section connected between the second tubing section and the manifold, the third tubing section being formed of polyvinylchloride.

14. An apparatus as recited in claim 8, wherein the manifold includes a plurality of inlets, a single outlet, an internal volume providing fluid communication between the inlets and the outlet, and a one-way flow valve associated with each line for allowing liquid to flow from each line into the manifold while preventing liquid in the manifold from flowing back into any of the lines.

15. An apparatus as recited in claim 8, wherein the manifold includes a plurality of inlets, a single outlet, an internal volume providing fluid communication between the inlets and the outlet, and a valve means for controlling the flow of liquid from the outlet, the valve means being movable between a flow-preventing position and a flow permitting position.

16. An apparatus as recited in claim 8, wherein the pumping means includes a separate peristaltic pump supported on the frame in association with each line.

17. An apparatus as recited in claim 8, wherein each sensing means is supported on the frame immediately behind each receptacle relative to the front wall so that the flow path along which flow is sensed intersects the receptacle.

18. A liquid receiving set for use with an apparatus for compounding a plurality of liquids and delivering the liquid at an outlet, the receiving set comprising:

a receiving container;

a receiving line in fluid communication with the container; and an end connector for connecting the line to the compounder apparatus, the end connector including a gripping portion by which the connector may be handled, an intermediate locking portion for locking the line in fluid communication with the apparatus, and an axially extending key portion sized for receipt in the outlet, the key portion including actuating means for actuating the release of compounded liquid from the outlet when the end connector is locked to the apparatus.

19. A liquid receiving set as recited in claim 18, wherein the container includes a first port through which liquid may be injected into the container, the first port being separate from the line.

20. A liquid receiving set as recited in claim 19, wherein the container includes a second port through which liquid may be removed from the container, the second port being separate from the line and the first port.

21. A liquid receiving set as recited in claim 18, wherein the locking portion of the connector includes a tapered frustoconical surface corresponding in shape to the outlet of the apparatus.

22. A liquid receiving set as recited in claim 18, wherein the key portion of the connector is an axial extension of the locking portion, having a generally arcuate crescent shape of a diameter smaller than the diameter of the locking portion.

23. A combination for use with an apparatus for compounding a plurality of liquids, the combination comprising:

a liquid supply set including a plurality of liquid supply lines, a delivery manifold, and a coupling means for coupling the lines to the manifold, the manifold including a plurality of inlets, a single outlet, an internal volume providing fluid communication between the inlet and the outlet, a valve means for controlling the flow of liquid from the outlet, the valve means being movable between a flow-preventing position and a flow-permitting position, and a biasing means for biasing the valve means toward the flow-preventing position; and a receiving set including a receiving container for receiving compounded liquid from the supply set, a receiving line in fluid communication with the container, and an end connector for connecting the receiving line to the outlet of the manifold, the end connector including a gripping portion by which the connector may be handled, an intermediate locking portion for locking the line in fluid communication with the outlet, and an axially extending key means sized for receipt in the outlet for moving the valve means from the flow-blocking position to the flow-permitting position to release compounded liquid within the manifold to the receiving set when the end connector is locked in the outlet.

24. A combination as recited in claim 23, wherein the locking portion of the connector includes a tapered frustoconical surface corresponding in shape to the outlet of the manifold so that when the connector is inserted into the outlet, the locking portion engages the outlet to seal the connector within the outlet.

25. A combination as recited in claim 23, wherein the key portion of the end connector is an axial extension of the locking portion, having a generally arcuate crescent shape of a diameter smaller than the diameter of the locking portion, the outlet including a projection protruding into the outlet and defining a crescent shaped opening through which the key portion of the end connector is received so that the key portion can move the valve means from the flow-blocking to the flow-permitting position.

26. A combination as recited in claim 23, wherein the valve means includes a seat formed in the outlet and a valve movable toward and away from the seat, the biasing means including a compression spring positioned within the internal volume between the manifold and the valve for biasing the valve toward the seat.

27. A combination as recited in claim 26, wherein the valve is a ball valve, the manifold including guide means for guiding movement of the ball valve between the seated and unseated positions.

28. A combination as recited in claim 23, wherein the manifold includes a check valve means positioned between the internal volume of the manifold and each of the lines for permitting liquid flow from the lines into the internal volume while checking the flow of liquid from the internal volume back into the lines.

29. A combination as recited in claim 28, wherein the internal volume of the manifold includes a separate fluid flow passageway communicating with each of the lines, the check valve means including a separate check valve positioned in each fluid flow passageway.

* * * * *